US010517449B2

(12) United States Patent
Han et al.

(10) Patent No.: US 10,517,449 B2
(45) Date of Patent: Dec. 31, 2019

(54) CYCLONE DUST COLLECTING APPARATUS AND HAND-HELD CLEANER HAVING THE SAME

(75) Inventors: Jung-gyun Han, Gwangju (KR); Ki-man Kim, Gwangju (KR); Seog-bong Baek, Busan (KR); Dong-jun Kim, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 595 days.

(21) Appl. No.: 13/067,371

(22) Filed: May 26, 2011

(65) Prior Publication Data

US 2011/0289720 A1 Dec. 1, 2011

Related U.S. Application Data

(60) Provisional application No. 61/349,938, filed on May 31, 2010.

(30) Foreign Application Priority Data

Sep. 15, 2010 (KR) ..... 10-2010-0090364

(51) Int. Cl.
*A47L 5/22* (2006.01)
*A47L 5/24* (2006.01)
(Continued)

(52) U.S. Cl.
CPC ..... *A47L 5/225* (2013.01); *A47L 5/24* (2013.01); *A47L 5/28* (2013.01); *A47L 9/122* (2013.01);
(Continued)

(58) Field of Classification Search
CPC . A47L 5/24; A47L 5/00; A47L 9/1608; A47L 5/225; A47L 9/165; A47L 5/28; A47L 9/122; B04C 2009/002
(Continued)

(56) References Cited

U.S. PATENT DOCUMENTS 5,819,364 A 10/1998 Sham
6,332,239 B1 12/2001 Dubos et al.
(Continued)

FOREIGN PATENT DOCUMENTS

DE 8814124 U1 1/1989
EP 1121044 B1 9/2004
(Continued)

OTHER PUBLICATIONS

Korean Office Action dated Jul. 17, 2012 in corresponding Korean Patent Application No. 10-2010-0090364.
(Continued)

*Primary Examiner* — David Redding
(74) *Attorney, Agent, or Firm* — Staas & Halsey LLP

(57) ABSTRACT

The hand-held cleaner includes a body, and a cyclone dust collecting apparatus detachably mounted in the body. The cyclone dust collecting apparatus includes a pre-motor filter unit having a filter grill and a filter member, a dust collecting bin having one end to which the pre-motor filter unit is coupled and the other end opposite to the one end in which an cyclone inlet is formed, and a cyclone bin disposed in the dust collecting bin and having a spiral flow path-guide member integrally formed therein. A moving path of air drawn into the cyclone inlet is maintained in the same direction until the air is discharged through the pre-motor filter unit via the cyclone bin.

7 Claims, 8 Drawing Sheets

(51) Int. Cl.

| | |
|---|---|
| ***A47L 5/28*** | (2006.01) |
| ***A47L 9/16*** | (2006.01) |
| ***B04C 9/00*** | (2006.01) |
| ***A47L 9/12*** | (2006.01) |

(52) U.S. Cl.
CPC ..... *A47L 9/165* (2013.01); *A47L 9/1608* (2013.01); *B04C 2009/002* (2013.01)

(58) Field of Classification Search
USPC ..... 15/344, 328, 329, 353
See application file for complete search history.

(56) References Cited

U.S. PATENT DOCUMENTS

| | | | | |
|---|---|---|---|---|
| D458,424 | S * | 6/2002 | Chen | D32/17 |
| 6,485,536 | B1 | 11/2002 | Masters | |
| 2004/0261382 | A1 | 12/2004 | Baldinger et al. | |
| 2005/0081321 | A1* | 4/2005 | Milligan | A47L 5/24 15/344 |
| 2007/0136987 | A1 | 6/2007 | Hsu | |
| 2007/0163075 | A1* | 7/2007 | Butler et al. | 15/410 |
| 2007/0271724 | A1* | 11/2007 | Hakan et al. | 15/329 |
| 2008/0040883 | A1* | 2/2008 | Beskow | A47L 5/225 15/329 |
| 2008/0289306 | A1 | 11/2008 | Han et al. | |
| 2010/0229328 | A1* | 9/2010 | Conrad | 15/344 |

FOREIGN PATENT DOCUMENTS

| | | | |
|---|---|---|---|
| EP | 1743560 | A2 | 1/2007 |
| EP | 1952743 | A2 | 8/2008 |
| EP | 1994870 | A2 | 11/2008 |
| EP | 2201875 | A2 | 6/2010 |
| FR | 2940901 | A1 | 7/2010 |
| JP | 9-206247 | | 8/1997 |
| JP | 2000-41909 | | 2/2000 |
| KR | 10-2008-0102647 | | 11/2008 |
| WO | WO 2004/069021 | A1 | 8/2004 |
| WO | WO 2007/111551 | A1 | 10/2007 |
| WO | 2008/088278 | A2 | 7/2008 |

OTHER PUBLICATIONS

Korean Office Action dated Feb. 25, 2013 for corresponding Korean Application No. 10-2010-0090364.
Extended European Search Report dated Jun. 11, 2013 in corresponding European Application No. 11167785.2.
Extended European Search Report dated Jun. 11, 2013 in corresponding European Application No. 11167786.0.
Notice of Opposition dated Jun. 8, 2017 in related European Patent Application No. 11167786.0.
European Communication dated Jul. 17, 2018 in European Patent Application No. 1116786.0.

* cited by examiner

CYCLONE DUST COLLECTING APPARATUS AND HAND-HELD CLEANER HAVING THE SAME

CROSS-REFERENCE TO RELATED APPLICATIONS

This application claims the benefit under 35 U.S.C. § 119(a) of Korean Patent Application No. 10-2010-0090364, filed on Sep. 15, 2010, in the Korean Intellectual Property Office, and U.S. Provisional Patent application No. 61/349,938, filed on May 31, 2010, in United States Patent and Trademark Office, the entire content of which is hereby incorporated by reference.

BACKGROUND

1. Field

The disclosure relates to a vacuum cleaner. More particularly, the present disclosure relates to a cyclone dust collecting apparatus, which collects a dirt or dust from an air, and a hand-held vacuum cleaner having the same.

2. Description of the Related Art

In general, a vacuum cleaner is an apparatus, which generates a suction force by means of a suction motor mounted in a cleaner body thus to draw in an air laden with a dust or dirt and then filters and collects the dust or dirt from the drawn-in air through a dust collecting apparatus. Particularly, a cyclone dust collecting apparatus, which is a dust collecting apparatus to form a whirling current in the air thus to separate the dust or dirt therefrom by using a centrifugal force generated by the whirling of air, does not requires replacing dust bags. Thus, the cyclone dust collecting apparatus can be semi-permanently used.

International Patent Publication WO 2008/088278 discloses a cyclone dust collecting apparatus and a hand-held cleaner having the same. The disclosed cyclone dust collecting apparatus is configured, so that an air flows into a cyclone inlet formed at a side thereof, goes down while whirling to separate a dust or dirt therefrom by a centrifugal force, converts a moving direction thereof at an angle of 180, and then passes through a filter while moving toward an upper part thereof in which a motor is disposed. However, in the cyclone dust collecting apparatus, there is a problem in that if the moving direction of air is reversed or sharply curved therein as above, the cyclone dust collecting apparatus may generate a loss in pressure due to such a change in flow path, thereby causing a dust separating efficiency thereof to deteriorate.

In addition, in even the hand-held cleaner having the cyclone dust collecting apparatus disclosed in the prior art as described above, a separate duct member is disposed to connect an inlet port formed at an lower end of the hand-held cleaner and a cyclone inlet formed at a side of an upper part of a dust collecting bin, and thus a long flow path in which an outer air drawn in through the inlet port is flowed into the dust collecting bin through the cyclone inlet via the duct member is provided. Accordingly, in even the hand-held cleaner, there is a problem in that a loss in air flow is large.

In particular, the hand-held cleaner can not use a high power suction motor because it is a small cleaner. Thus, in the hand-held cleaner, a decrease in dust separating efficiency due to the loss in pressure or flow tends to appear larger than that in a general vacuum cleaner.

SUMMARY

An aspect of the present disclosure is to address at least the above problems and/or disadvantages and to provide at least the advantages described below. Accordingly, an aspect of the present disclosure is to provide a cyclone dust collecting apparatus, which has a reduced pressure loss and an improved dust collecting efficiency, and a hand-held vacuum cleaner having the same.

According to an aspect of the present disclosure, a cyclone dust collecting apparatus includes a pre-motor filter unit having a filter grill and a filter member, a dust collecting bin having one end to which the pre-motor filter unit is coupled and the other end opposite to the one end in which an cyclone inlet is formed, and a cyclone bin disposed in the dust collecting bin and having a spiral flow path-guide member integrally formed therein, wherein a moving path of air drawn into the cyclone inlet is maintained in the same direction until the air is discharged through the pre-motor filter unit via the cyclone bin.

The dust collecting bin may further include an anti-back flow rib extended from the cyclone inlet toward the pre-motor filter unit.

The pre-motor filter unit may be coupled to an upper end of the dust collecting bin, and the cyclone inlet may be formed in a lower end of the dust collecting bin.

The pre-motor filter unit may include an upper casing and a lower casing, the filter member may be mounted between the upper casing and the lower casing, and the filter grill may be convexly projected from the lower casing.

According to another aspect of the present disclosure, a hand-held cleaner includes a body, and a cyclone dust collecting apparatus detachably mounted in the body. The cyclone dust collecting apparatus includes a pre-motor filter unit having a filter grill and a filter member, a dust collecting bin having one end to which the pre-motor filter unit is coupled and the other end opposite to the one end in which an cyclone inlet is formed, and a cyclone bin disposed in the dust collecting bin and having a spiral flow path-guide member integrally formed therein, wherein a moving path of air drawn into the cyclone inlet is maintained in the same direction and not changed until the air is discharged through the pre-motor filter unit via the cyclone bin.

The body may include a cyclone mounting space for accommodating the cyclone dust collecting apparatus, a vacuum source provided on one side of the cyclone mounting space, and a cleaner inlet port provided on the other side of the cyclone mounting space to communicate with the cyclone inlet.

The body may further include a rib formed on and projected from the cleaner inlet port.

The body may further include a roller disposed on a lower end of the cleaner inlet port to rotate while being in contact with a surface to be cleaned thereby to allow the hand-held cleaner to be easily moved back and forth.

The body may be mounted in a stick body to be usable as a stick cleaner.

According the foregoing description, the cyclone dust collecting apparatus of the invention disclosure is configured, so that the cyclone inlet is formed on one end, that is, a lower surface of the dust collecting bin and the pre-motor filter unit including the grill is detachably disposed on the other end opposite to the one end, that is, an upper end of the dust collecting bin, thereby preventing a portion by which an air flow is depressed from generating thus to reduce a loss in pressure and to improve a dust collecting efficiency.

In addition, the hand-held cleaner of the invention disclosure is configured so that the cleaner inlet port is connected with the cyclone inlet formed on the lower surface of the dust collecting bin without using any separate duct member, thereby allowing an air path and a loss in air flow to shorten and reduce thus to improve the dust collecting efficiency of the cyclone dust collecting apparatus.

Also, the cyclone dust collecting apparatus of the invention disclosure is configured, so that the anti-back flow rib is internally projected and disposed in the cyclone inlet, thereby preventing a dust or dirt in the cyclone bin from flowing backward through the cyclone inlet.

BRIEF DESCRIPTION OF THE DRAWINGS

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION

Hereinafter, a cyclone dust collecting apparatus and a hand-held vacuum cleaner having the same according to certain exemplary embodiments of the present disclosure will be described in detail with reference to the accompanying drawing figures.

In the following description, the matters defined in the description, such as detailed construction and elements, are provided to assist in a comprehensive understanding of the invention. However, the present disclosure can be practiced without those specifically defined matters. Also, well-known functions or constructions are not described in detail since they would obscure the invention with unnecessary detail.

Figure 1:
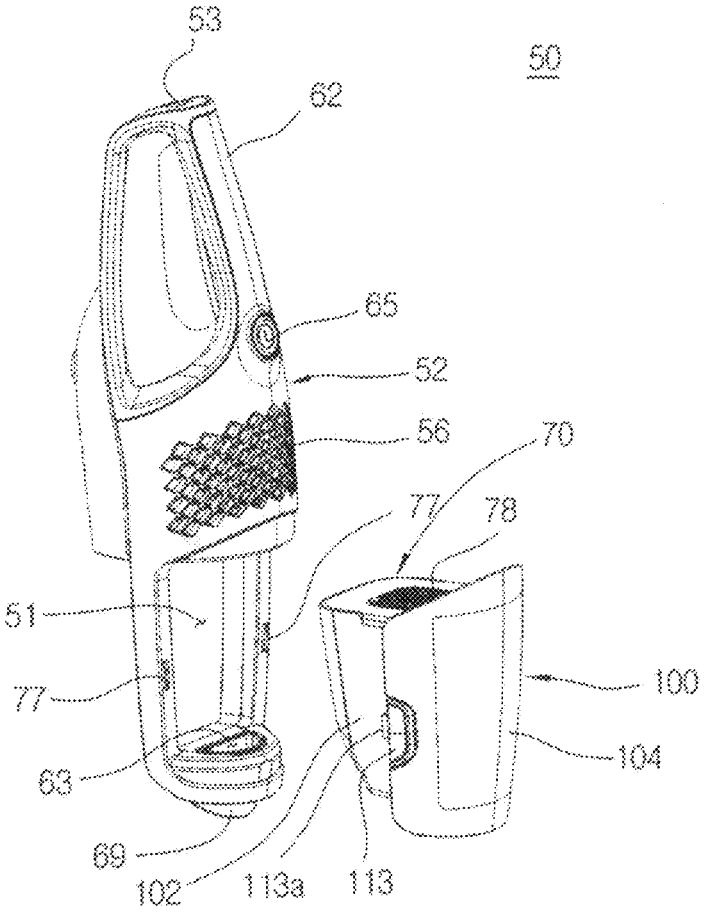
FIG. 1 is an exploded perspective view showing a handy type cleaner according to an exemplary embodiment of the present disclosure in a state where a cyclone dust separating apparatus according to an exemplary embodiment of the present disclosure is separated from a body.

Referring to FIG. 1, a hand-held cleaner 50 according to an exemplary embodiment of the present disclosure includes a body 52, and a cyclone dust collecting apparatus 100.

On a front part of the body 52 are provided a first discharge part 56 in the form of a grill having a plurality of discharge holes, a handle 62 and a power button 65. A vacuum source M (see FIG. 6) for generating a suction force and a battery (not shown) are mounted in an upper part of the body 52. On a rear part of the body 52, a second discharge part 58 (see FIG. 5) in the form of a grill having a plurality of discharge holes is formed at a position opposite to that of the first discharge part 56. On the rear part of the body 52, a second connecting terminal 60 (see FIG. 8) is disposed on an upper part of the second discharge part 58. A roller 114 (see FIGS. 5 and 6) is rotatably disposed on a lower end of the body 52. A cyclone mounting space 51 in which the cyclone dust collecting apparatus 100 is mounted is penetrated through and formed in the lower part of the handy 52.

Figure 4:
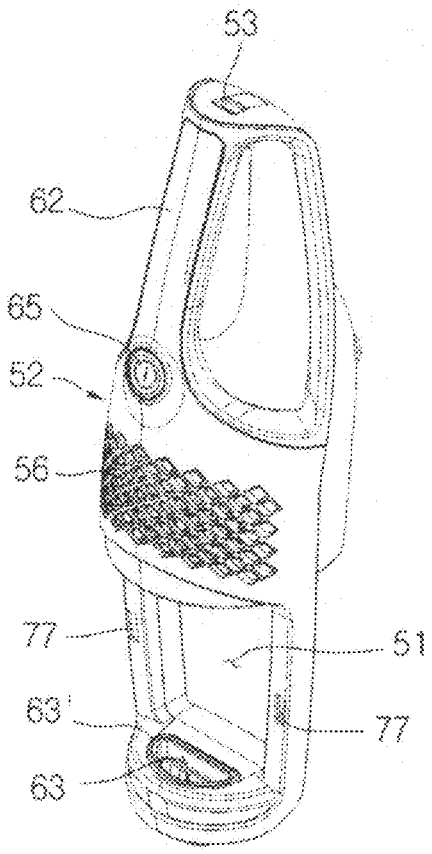
FIG. 4 is a perspective view showing the hand-held cleaner of FIG. 1 in a state where the body from which the cyclone dust separating apparatus is removed stands up.
Figure 5:
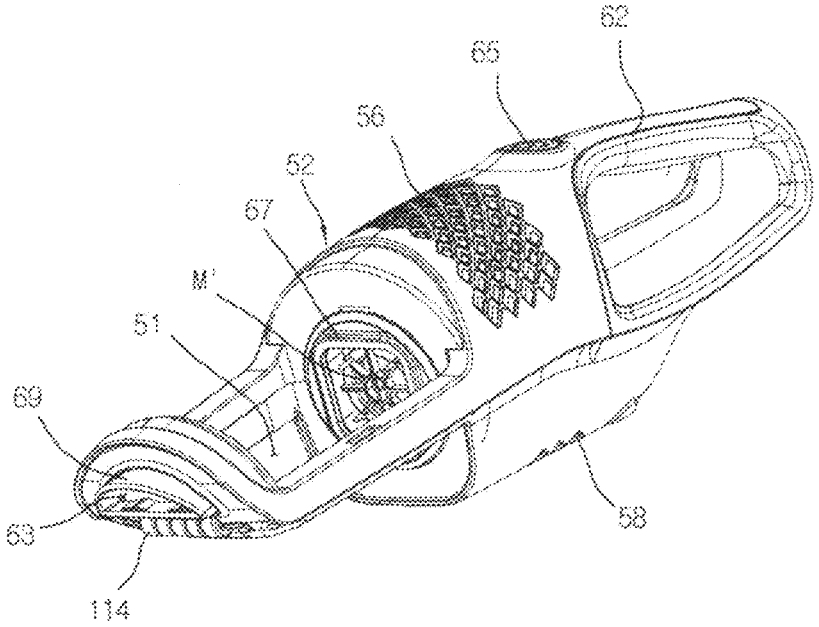
FIG. 5 is a perspective view showing the hand-held cleaner in a state where the body of FIG. 4 lies down.
Figure 6:
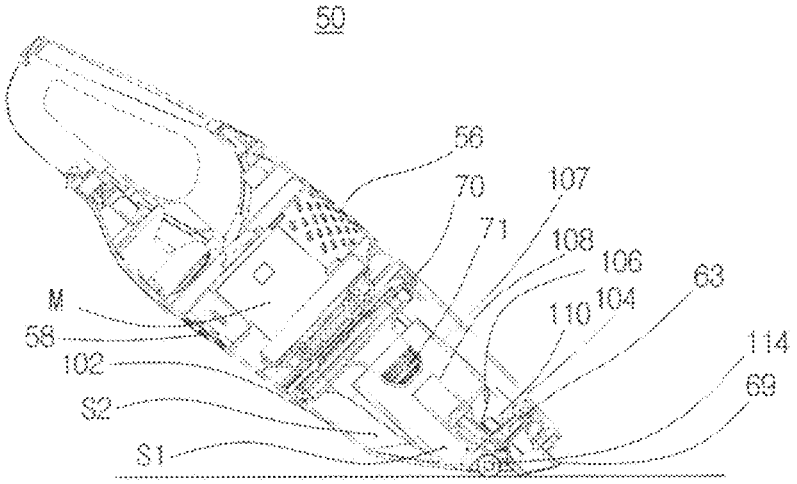
FIG. 6 is a cross-sectional view showing the hand-held cleaner shown in FIG. 1 in use.

Referring to FIGS. 4 to 6, the body 52 includes a cleaner inlet port 63, a roller 114, an inlet gasket 63', an outlet gasket 67, and a rib 69. The cleaner inlet port 63 is coupled with an opening 4 of a stick body 14 and a cyclone inlet 110 while being in tight contact therewith. The inlet gasket 63' is disposed on a circumferential surface of the cleaner inlet port 63 to prevent an air from being leaked through coupled portions of the cleaner inlet port 63 and the cyclone inlet 110. The outlet gasket 67 is disposed around a motor inlet port M' formed on an upper part of the cyclone mounting space 51 to increase a contact force of coupled portions between a pre-motor filter unit 70 and the body 52 thus to prevent an air from being leaked therethrough.

The roller 14 is disposed on a lower part of the cleaner inlet port 63, and when the hand-held cleaner 50 is used being separated from the stick body 14, rotates while being in contact with a surface to be cleaned thus to allow the hand-held cleaner 50 to easily move back and forth and to reduce a friction between the surface to be cleaned and the hand-held cleaner 50.

The rib 69 is formed on and projected from the cleaner inlet port 63, and when the hand-held cleaner 50 is mounted in a mounting space 3, is inserted into the opening 4 of the stick body 14 to prevent an air from being leaked between the cleaner inlet port 63 and the opening 4. In addition, when the hand-held cleaner 50 is tilted to allow the cleaner inlet port 63 to be in contact with the surface to be cleaned, the rib 69 reduces a separated space between the surface to be cleaned and the cleaner inlet port 63 to allow the suction force of the vacuum source M to be transmitted to the surface to be cleaned well, thereby improving a dust suction performance of the hand-held cleaner to the surface to be cleaned.

Figure 2:
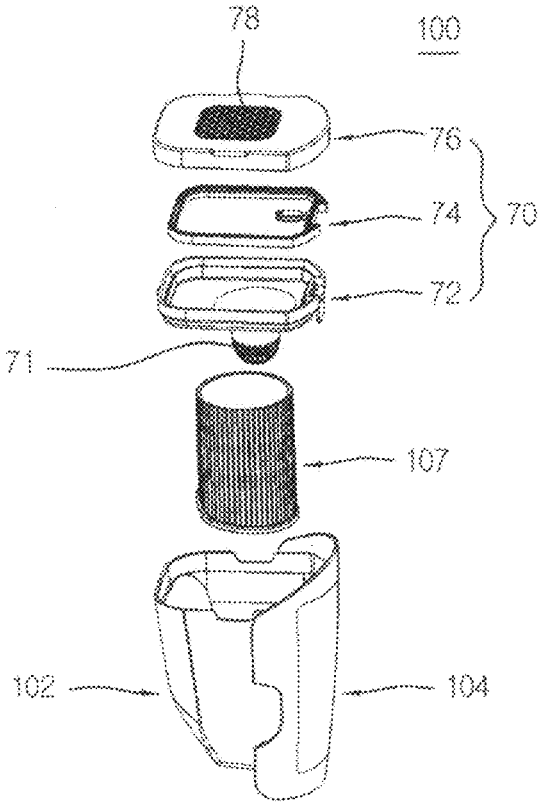
FIG. 2 is an exploded perspective view of the cyclone dust separating apparatus shown in FIG. 1.
Figure 3:
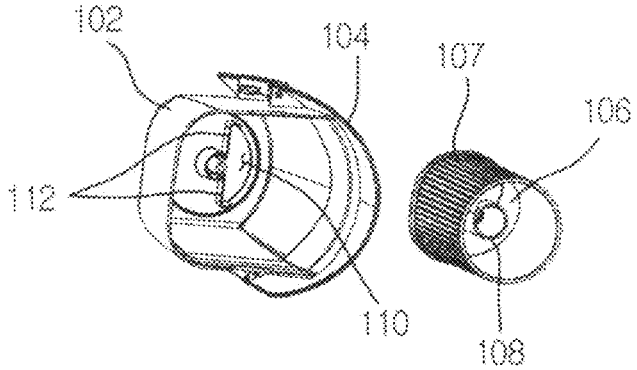
FIG. 3 is a perspective view showing a dust collecting bin and a cyclone bin of the cyclone dust separating apparatus shown in FIG. 2, as viewed from above.

Referring to FIGS. 2, 3 and 6, the cyclone dust collecting apparatus 100 according to an exemplary embodiment of the present disclosure includes a dust collecting bin 102, a cover member 104, a pre-motor filter unit 70 and a cyclone bin 107.

The dust collecting bin 102 is made of a transparent material and has an approximately rectangle shape. The pre-motor filter unit 70 is detachably mounted on a side of the duct collecting bin 102.

The cover member 104 is made of a transparent material and integrally formed with the dust collecting bin 102. The cover member 104 forms an outer surface of the hand-held cleaner 50 when the cyclone dust collecting apparatus 100 is mounted in the cyclone mounting space 51 of the hand-held cleaner 50.

On both side ends of the cover member 104 is disposed a pair of locking members 113, which is able to be hinged and elastically supported by springs (not shown). Thus, a user can push the pair of locking members 113 with her or his one hand to lock or release them in or from locking grooves 77 (see FIG. 4) formed on both sides of the cyclone mounting space 51 of the body 52, thereby assembling or separating the cyclone dust collecting apparatus 100 in or from the body 52.

Figure 7:
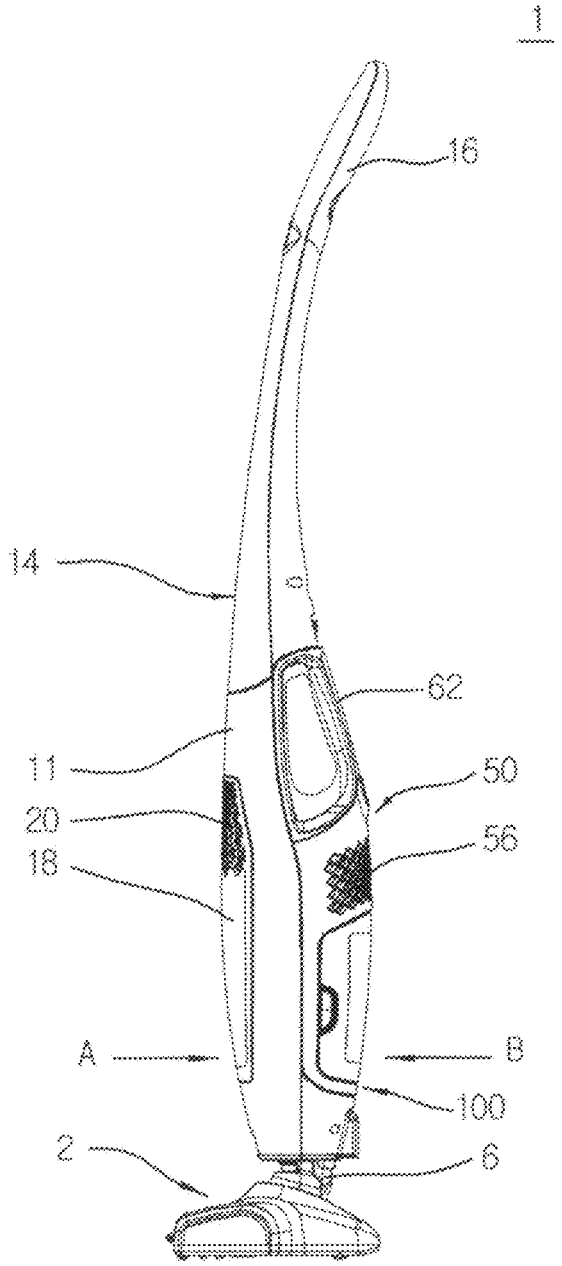
FIG. 7 is a right side view showing a stick cleaner including the hand-held cleaner according to an exemplary embodiment of the present disclosure to which the hand-held cleaner having the cyclone dust separating apparatus shown in FIG. 1 is applied.

Referring to FIGS. 1 to 3 and 6, since in the cyclone dust collecting apparatus 100, the dust collecting bin 102 and the cover member 104 are transparent, the user can check the amount of dust collected in the dust collecting bin 102 or an operation state thereof in the cyclone dust collecting apparatus 100 with her or his eyes from the outside. Further, the user can see the inside of the cyclone dust collecting apparatus 100 from the front part and the rear part of the hand-held cleaner 50 even when the cyclone dust collecting apparatus 100 is mounted in the cyclone mounting space 51. Also, the user can see the inside of the cyclone dust collecting apparatus 100 through a front part of a stick vacuum cleaner 1 (see FIG. 7) even when the hand-held cleaner 50 is mounted in the stick body 14. In other words, through a body-transparent part 18 of the stick body 14, the user can check the inside of the cyclone dust collecting apparatus 100 with her or his eyes. Referring to FIG. 7, the user can see the inside of the cyclone dust collecting apparatus 100 through a rear part of the handy-and-stick type vacuum cleaner 1. In other words, when the stick vacuum cleaner 1 is used, the user can check the inside of the cyclone dust collecting apparatus 100 through the rear part of the stick vacuum cleaner 1 even if she or he does not move in front of the stick vacuum cleaner 1.

Referring to FIG. 3, the cyclone bin 107 is disposed in the dust collecting bin 102 to divide an inner space of the dust collecting bin 102 into a centrifugal chamber S1 and a dust accommodating chamber S2 (see FIG. 6). A central pipe 108 is provided in a center of the cyclone bin 107, and a spiral flow path-guide member 106 for inducing a rotation of air drawn in through a cyclone inlet 110 is disposed between the cyclone bin 107 and the central pipe 108.

Referring to FIGS. 2, 3 and 6, the pre-motor filter unit 70 is disposed to be coupled to a upper part of the dust collecting bin 102, and includes an upper casing 76, a lower casing 72, and a filter member 74. A grill 71 is convexly projected from the lower casing 72, and a plurality of air holes 78 for discharge of an air is formed in the upper casing 76. The filter member 74 is mounted between the upper casing 76 and the lower casing 72. When the pre-motor filter unit 70 is mounted in the dust collecting bin 102, the convex grill 71 is inserted to a certain extent into the cyclone bin 107, that is, the centrifugal chamber S1. The convex grill 71 allows the air to maintain a whirling force in an upper part of the cyclone bin 107, and first filters a relatively large dust or dirt from the air discharged from the centrifugal chamber S1. Further, the filter member 74 secondly separates a fine dust or dirt from the air past the grill 71.

As shown in FIG. 1, when the cyclone duct collecting apparatus 100 is separated from the hand-held cleaner 50, the pre-motor filter unit 70 along with the cyclone duct collecting apparatus 100 is separated therefrom. To dump the dust or dirt, the user should separate the pre-motor filter unit 70 from the cyclone duct collecting apparatus 100. Thus, whenever the user dumps the dust or dirt, she or he can naturally check contamination levels of the pre-motor filter unit 70 and timely replace the filter member 74 with a new one.

Referring to FIGS. 2 to 6, the cyclone inlet 110 is formed in a lower surface of the dust collecting bin 102 to come in tight contact with the cleaner inlet port 63, and has a semicircle shape. Around an inner side of the cyclone inlet 110 is provided an anti-back flow rib 112, which is projected toward the inside of the dust collecting bin 102. Although the anti-back flow rib 112 is illustrated as being provided on a portion of a circumference of the cyclone inlet 110, it may be formed on the entire circumference of the cyclone inlet 110 to project to a certain distance into the cyclone bin 107 therefrom. The anti-back flow rib 112 acts to prevent the dust or dirt remained in the cyclone bin 107 from flowing out through the cyclone inlet 110.

Referring to FIG. 3, a central pipe 108 and a flow path-guide member 106 are disposed in the cyclone bin 107. The flow path-guide member 106 has spiral shape, and is disposed between an outer surface of the central pipe 108 and an inner surface of the cyclone bin 107. The air draw in through the cyclone inlet 110 rides on the flow path-guide member 106 and rotates while forming a whirling current to separate the dust or dirt therefrom.

FIGS. 7 to 10 are views showing a stick cleaner 1 according to an exemplary embodiment of the present disclosure to which the hand-held cleaner 50 is applied.

Referring to FIGS. 7 to 10, the stick cleaner 1 of the present disclosure includes a stick body 14, a nozzle assembly 2, and a hand-held cleaner 50.

The stick body 14 is divided into a handle 16 provided on an upper part thereof and a central part 11 in the form of a jar provided on a lower part thereof. The handle 16, as a portion coupled to an upper end of the central part 11, is a portion, which is gripped by the user, so that she or he can push or pull the nozzle assembly 2 when using the stick cleaner 1. A mounting space 3 formed in the central part 11 is a space, which can mount or separate the hand-held cleaner 50 in or from the stick body 14.

In FIG. 7, a front part of the stick body 14 is a side of the stick body 14, which is viewed from a direction of arrow A, and a rear part of the stick body 14 is a side of the stick body 14, which is viewed from a direction of arrow B. Referring to FIG. 7, a body discharge part 20, which is made up of a plurality of discharge holes, is formed in the front part of the stick body 14, and the body-transparent part 18, which is made of a transparent panel, is formed below the body discharge part 20.

Figure 10:
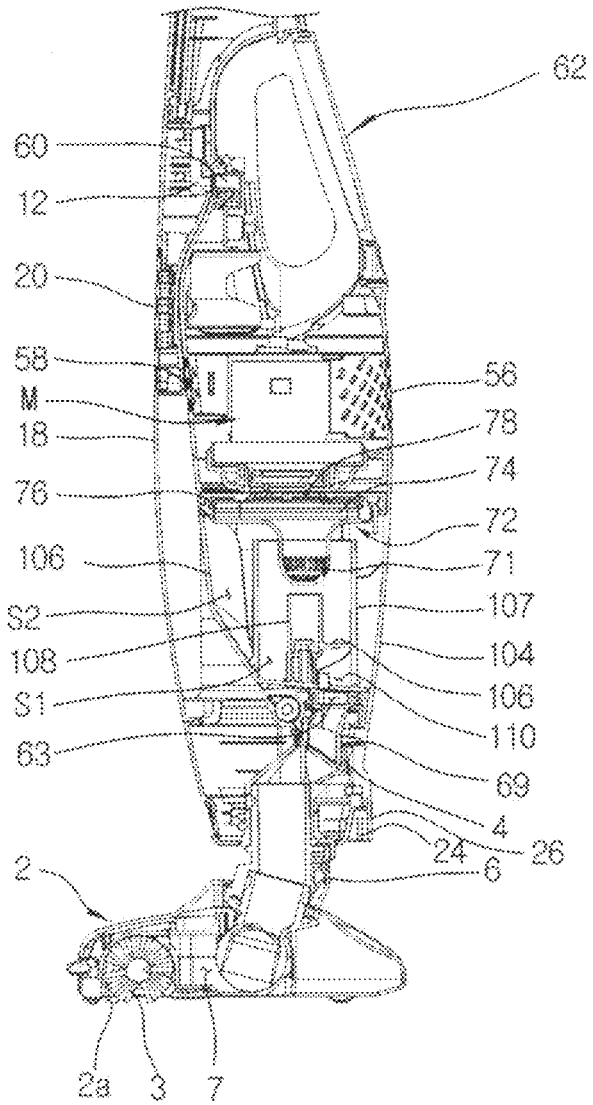
FIG. 10 is a cross-sectional view of the stick cleaner of FIG. 7.

The nozzle assembly 2 is rotatably coupled to a lower end of the stick body 14, and an inner air passage 7 (see FIG. 10) in the nozzle assembly 2 is communicated with a neck part 6 and the opening 4 of the stick body 14. Accordingly, an external air and a dust or dirt drawn in through the nozzle assembly 2 are flowed into the hand-held cleaner 50 through the neck part 6 and the opening 4 of the stick body 14. Referring to FIG. 10, a bottom inlet port 2*a* for drawing in the air from the surface to be cleaned is formed in a lower surface of the nozzle assembly 2 and a cylindrical brush 3 for brushing off the dust or dirt from the surface to be cleaned is rotatably disposed in the nozzle assembly 2.

Figure 8:
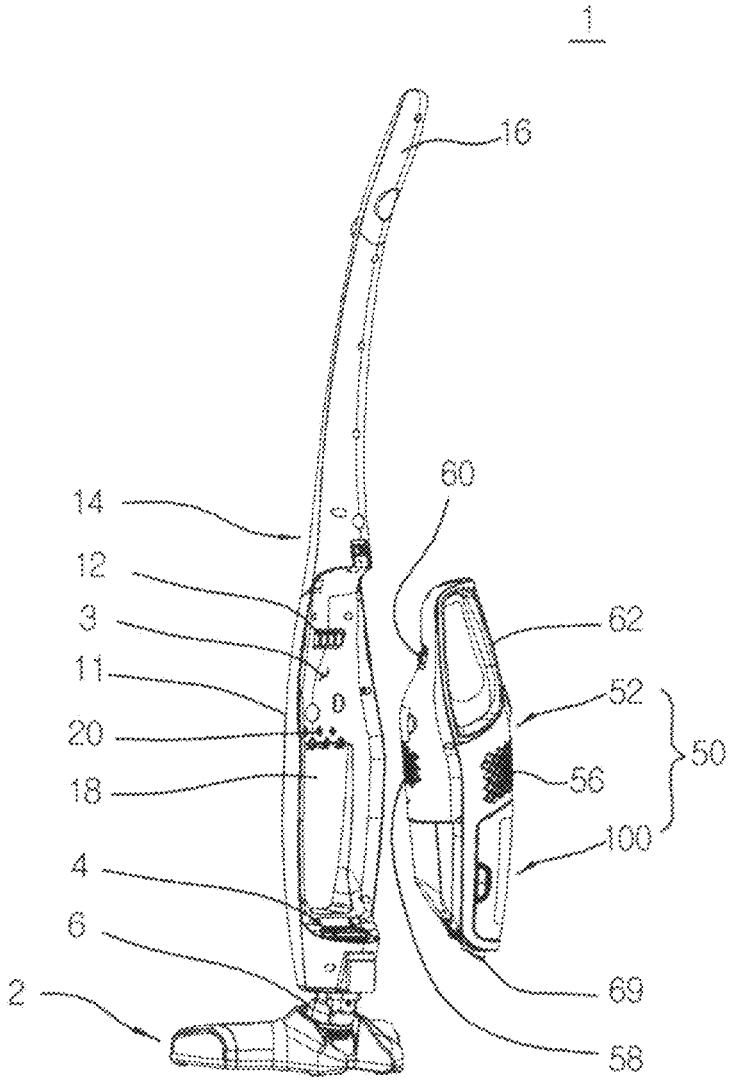
FIG. 8 is an exploded perspective view showing the stick cleaner of FIG. 7 to which the hand-held cleaner having the cyclone dust separating apparatus shown in FIG. 1 is applied in a state where the hand-held cleaner is separated from a stick body.
Figure 9:
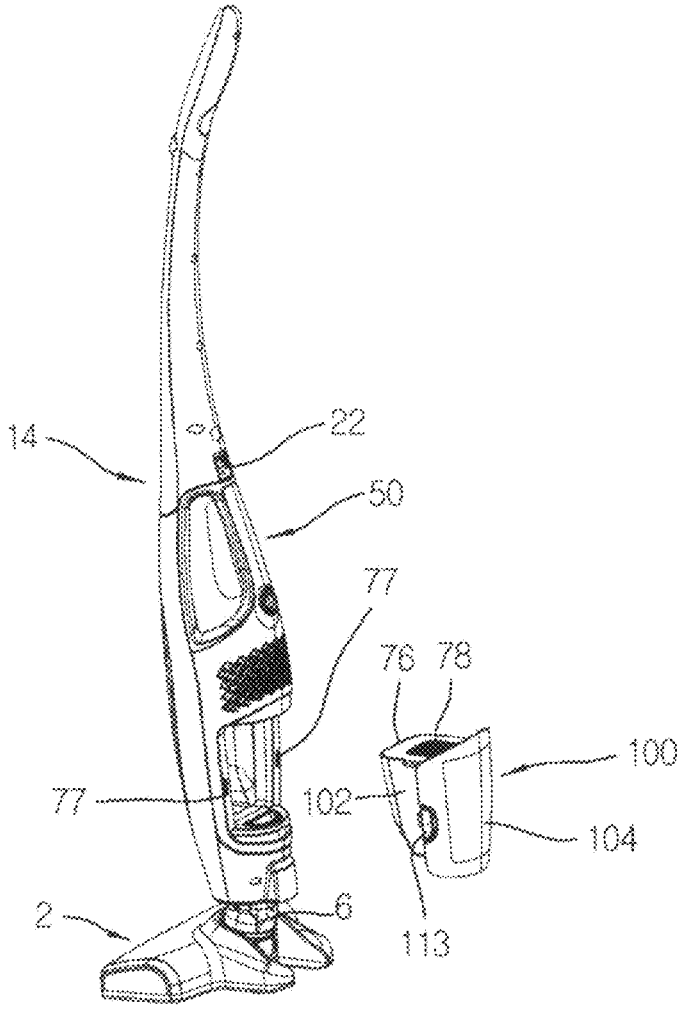
FIG. 9 is an exploded perspective view showing the handy-and-stick type cleaner of FIG. 7, in a state where the cyclone dust separating apparatus is separated from the hand-held cleaner.

Referring to FIGS. 7 and 8, a first connecting terminal 12 is provided in the mounting space 3 of the stick body 14, and a second connecting terminal 60 is disposed on the rear part of the hand-held cleaner 50. If the hand-held cleaner 50 is mounted in the mounting space 3, the first and the second connecting terminals 12 and 60 come in contact with or to each other and thus the stick body 14 and the hand-held cleaner 50 are electrically connected. In FIG. 9, a reference number 22 is a locking button, which when the hand-held cleaner 50 is fixed in or separated from the mounting space 3, is selectively engaged with a locking groove 53 (see FIG. 1) formed on an upper end of the body 52 of the hand-held cleaner 50.

Hereinafter, operations of the cyclone dust collecting apparatus 100 according to the exemplary embodiment of the present disclosure and the hand-held cleaner 50 having the same and an operation the handy-and-stick type vacuum cleaner 1 to which the cyclone dust collecting apparatus 100 and the hand-held cleaner 50 are applied will be explained with reference to the drawings as described above.

The user can separate the hand-held cleaner 50 according to the exemplary embodiment of the present disclosure from the rear part of the stick body 14 to clean a surface to be cleaned by using only the hand-held cleaner 50 (hereinafter, referred as 'hand-held cleaning').

Referring to FIGS. 1 to 6, in the hand-held cleaning, the user turns on/off the vacuum source M disposed in the body 52 by using the power button 65 disposed on the body 52. To draw in an external air and a dust or dirt from the surface to be cleaned, the user can move the hand-held cleaner 50 while bringing the cleaner inlet port 63 and the roller 114 in contact with the surface to be cleaned. The operation of the hand-held cleaner 50 allows the external air to flow into the cyclone dust collecting apparatus 100 through the cleaner inlet port 63 and the cyclone inlet 110. Since the cyclone inlet 110 is located on the lower part of the cyclone dust collecting apparatus 100, the air passed through the cleaner inlet port 63 is quickly flowed into the cyclone inlet 110 coming in contact therewith. The flowed-into external air laden with the dust or dirt is flowed into the centrifugal chamber S1 while whirling along the spiral flow path-guide member 106, and the dust or dirt included in the air is separated from the air by the whirling centrifugal force and crosses the upper end of the cyclone bin 107 to be stored in the dust collecting bin 102. The air from which the dust or dirt is separated as described above continues going straight upward without changing a moving direction thereof and then passes through the pre-motor filter unit 70 mounted in the upper part of the cyclone bin 107. At this time, a fine dust or dirt remained in the air is removed by the grill 71 and the filter member 74, and the air is discharged to the first and the second discharge parts 56 and 58 via the vacuum source M. Even if while the hand-held cleaner 50 is used as shown in FIG. 6, the dust or dirt is remained in the centrifugal chamber S1, the anti-back flow member 112 provided in the cyclone inlet 110 prevents the dust or dirt from being out of the cyclone inlet 110.

Referring to FIGS. 7 to 10, if the user mounts the hand-held cleaner 50 of the present disclosure in the stick body 14 in order to use the stick cleaner (hereinafter, referred as 'stick type cleaning'), she or he pushes the power switch disposed on the stick body 14 to operate the stick vacuum cleaner 1, and then grips the handle 16 of the stick body 14 with her or his hand and uses the stick body 14, tilting the stick body 14 to the nozzle assembly 2. The user properly tilts the stick body 14 to meet her or his physical condition and then cleans the surface to be cleaned while moving the handy-and-stick type vacuum cleaner 1 in every direction. The external air laden with the dust or dirt is flowed into the cyclone dust collecting apparatus 100 via the nozzle assembly 2, the neck part 6 and the opening 4 of the stick body 14. The external air flowed into the cyclone dust collecting apparatus 100 whirls in the centrifugal chamber S1, and the dust or dirt included in the external air is separated from the external air by the whirling centrifugal force and stored in the dust collecting bin 102. The air from which the dust or dirt is separated passes through the pre-motor filter unit 70 to remove fine dust or dirt therefrom by means of the grill 71 and the filter member 74, and then is discharged to the first and the second discharge parts 56 and 58 of the hand-held cleaner 50 via the vacuum source M. Among this air, the air discharged to the second discharge part 58 is discharged to the front part of the stick body 14 through the body discharge part 20.

According the foregoing description, the cyclone dust collecting apparatus 100 according the exemplary embodiment of the invention disclosure is configured, so that the cyclone inlet 110 is formed on the lower surface of the dust collecting bin 102 and the pre-motor filter unit 70 including the grill 71 is detachably disposed in almost straight line on the upper end of the dust collecting bin 102, thereby preventing a flowing direction of air from being changed in the cyclone dust collecting apparatus 110. Accordingly, in the cyclone dust collecting apparatus 100, a loss in pressure is reduced and a dust collecting efficiency is improved. In addition, the anti-back flow rib 112 is internally projected and disposed in the cyclone inlet 110, thereby preventing the dust or dirt in the cyclone bin 107 from flowing backward through the cyclone inlet 112 and thus allowing convenience to improve.

Also, the hand-held cleaner 50 according the exemplary embodiment of the invention disclosure is configured so that the cleaner inlet port 63 is directly connected with the cyclone inlet 110 formed on the lower surface of the dust collecting bin 102 without using any separate duct member, thereby allowing a loss in air flow due to an inflow of air to reduce thus to improve the dust collecting efficiency of the cyclone dust collecting apparatus 100.

Although representative embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A stick cleaner comprising:

a stick body comprising a handle provided on an upper part thereof and a central part in a form of a jar provided on a lower part thereof;

a nozzle assembly rotatably coupled to a lower end of the stick body;

a mounting space formed in the central part;

an inner air passage connecting the nozzle assembly and the mounting space; and a hand-held cleaner detachably mounted in the mounting space to provide suction force to the nozzle assembly through the inner air passage, wherein the hand-held cleaner comprises a body; and a cyclone dust collecting apparatus detachably mounted in the body, wherein the cyclone dust collecting apparatus comprises a pre-motor filter unit having a filter grill and a filter member;

a dust collecting bin having one end to which the pre-motor filter unit is coupled and another end opposite to the one end in which a cyclone inlet is formed; and a cyclone bin disposed in the dust collecting bin and having a central pipe, a spiral flow path-guide member integrally formed between an outer surface of the central pipe and an inner surface of the cyclone bin, and a bottom opening, wherein a direction of a moving path of air drawn into the cyclone inlet is the same as a direction of a moving path of air discharged through the pre-motor filter unit via the cyclone bin; and wherein the cyclone bin is disposed on top of the cyclone inlet to allow for the air to be introduced directly from the cyclone inlet of the dust collecting bin into the bottom opening of the cyclone bin.

2. The stick cleaner as claimed in claim 1, wherein the body comprises a cyclone mounting space to accommodate the cyclone dust collecting apparatus, a vacuum source provided on one side of the cyclone mounting space, and a cleaner inlet port provided on another side of the cyclone mounting space to communicate with the cyclone inlet.

3. The stick cleaner as claimed in claim 2, wherein the body further comprises a rib formed on and projected from the cleaner inlet port.

4. The stick cleaner as claimed in claim 1, wherein the dust collecting bin further comprises an anti-backflow rib extended from the cyclone inlet toward the pre-motor filter unit.

5. The stick cleaner as claimed in claim 1, wherein the pre-motor filter unit further comprises an upper casing and a lower casing, the filter member is mounted between the upper casing and the lower casing, and the filter grill is convexly projected from the lower casing.

6. The stick cleaner as claimed in claim 1, wherein the body further comprises a roller disposed on a lower end of the cleaner inlet port to rotate while being in contact with a surface to be cleaned to thereby allow the hand-held cleaner to be easily moved back and forth.

7. The stick cleaner as claimed in claim 1, wherein the cyclone bin is disposed in the dust collecting bin to divide an inner space of the dust collecting bin into a centrifugal chamber and a dust accommodating chamber.

* * * * *